US009532671B2

(12) United States Patent
Lin

(10) Patent No.: US 9,532,671 B2
(45) Date of Patent: Jan. 3, 2017

(54) CARAFE

(71) Applicant: G.L. PRODUCTION (HANGZHOU) LTD., Hangzhou (CN)

(72) Inventor: Geoffery Lin, Hong Kong (HK)

(73) Assignee: G.L. PRODUCTION (HANGZHOU) LTD., Hangzhou (CN)

( * ) Notice: Subject to any disclaimer, the term of this patent is extended or adjusted under 35 U.S.C. 154(b) by 22 days.

(21) Appl. No.: 14/747,840

(22) Filed: Jun. 23, 2015

(65) Prior Publication Data

US 2015/0374151 A1 Dec. 31, 2015

(30) Foreign Application Priority Data

Jun. 25, 2014 (CN) ..... 2014 2 0341250 U

(51) Int. Cl.
*A47G 19/12* (2006.01)
*B65D 39/00* (2006.01)
*B65D 39/06* (2006.01)

(52) U.S. Cl.
CPC ..... *A47G 19/12* (2013.01); *A47G 19/127* (2013.01)

(58) Field of Classification Search
CPC ..... A47G 19/12; A47G 19/127
USPC ..... 222/563, 559, 561, 566–570, 131, 545
See application file for complete search history.

(56) References Cited

U.S. PATENT DOCUMENTS 2,091,460 A * 8/1937 Valliant ..... B65D 49/04 215/18
2,141,174 A * 12/1938 Davis ..... B65D 49/04 215/21
3,073,470 A * 1/1963 Greene ..... B65D 49/06 215/22
3,399,811 A * 9/1968 Miller ..... B65D 49/04 222/147
6,394,313 B1 * 5/2002 Wesley ..... A47J 37/1271 210/244
9,211,982 B2 * 12/2015 Kohler ..... A47G 19/12
2011/0198352 A1 * 8/2011 Lown ..... A47G 19/12 220/254.8
2013/0087585 A1 * 4/2013 Huynh ..... B65D 47/20 222/500
2014/0263156 A1 * 9/2014 Newsom ..... B65D 41/3495 215/258

* cited by examiner

*Primary Examiner* — Donnell Long
(74) *Attorney, Agent, or Firm* — patenttm.us

(57) ABSTRACT

A carafe has a flask and a lid assembly. The flask has a vessel. The lid assembly has a plug lid with an outlet port, a limiting bracket with a guiding channel and at least one outlet, and a sealing ball mounted in the guiding channel. The limiting bracket is mounted in the outlet port of the plug lid and is connected to the plug lid. When an opening of the vessel faces upward, the sealing ball slides downward to seal the outlet port of the plug lid. When the vessel tilts and the opening of the vessel faces downward, the outlet port of the plug lid is open, so that liquid in the vessel can flow out of the vessel. A user does not have to press or turn the lid assembly. Therefore, it is convenient to pour liquid out of the vessel.

13 Claims, 5 Drawing Sheets

CARAFE

BACKGROUND OF THE INVENTION

1. Field of the Invention

The present invention relates to a carafe, especially to a carafe for containing liquid.

2. Description of the Prior Art(s)

A conventional carafe includes a flask and a lid assembly. The lid assembly is mounted in and seals an opening of the flask. Before pouring, a user should press or turn the lid assembly, so as to open the lid assembly to allow liquid, such as water, in the flask to flow out of the flask. Sometimes, it needs both of the user's hands to open the lid assembly. Moreover, the user has to press or turn the lid assembly again to close the lid assembly, which is inconvenient and troublesome.

To overcome the shortcomings, the present invention provides a carafe to mitigate or obviate the aforementioned problems.

SUMMARY OF THE INVENTION

The main objective of the present invention is to provide a carafe. The carafe has a flask and a lid assembly. The flask has a vessel. The lid assembly has a plug lid with an outlet port, a limiting bracket with a guiding channel and at least one outlet, and a sealing ball mounted in the guiding channel. The limiting bracket is mounted in the outlet port of the plug lid and is connected to the plug lid.

When an opening of the vessel faces upward, the sealing ball slides downward to seal the outlet port of the plug lid. When the vessel tilts and the opening of the vessel faces downward, the outlet port of the plug lid is open, such that liquid in the vessel can flow out of the vessel. A user does not have to press or turn the lid assembly. Therefore, it is convenient to pour the liquid out of the vessel.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
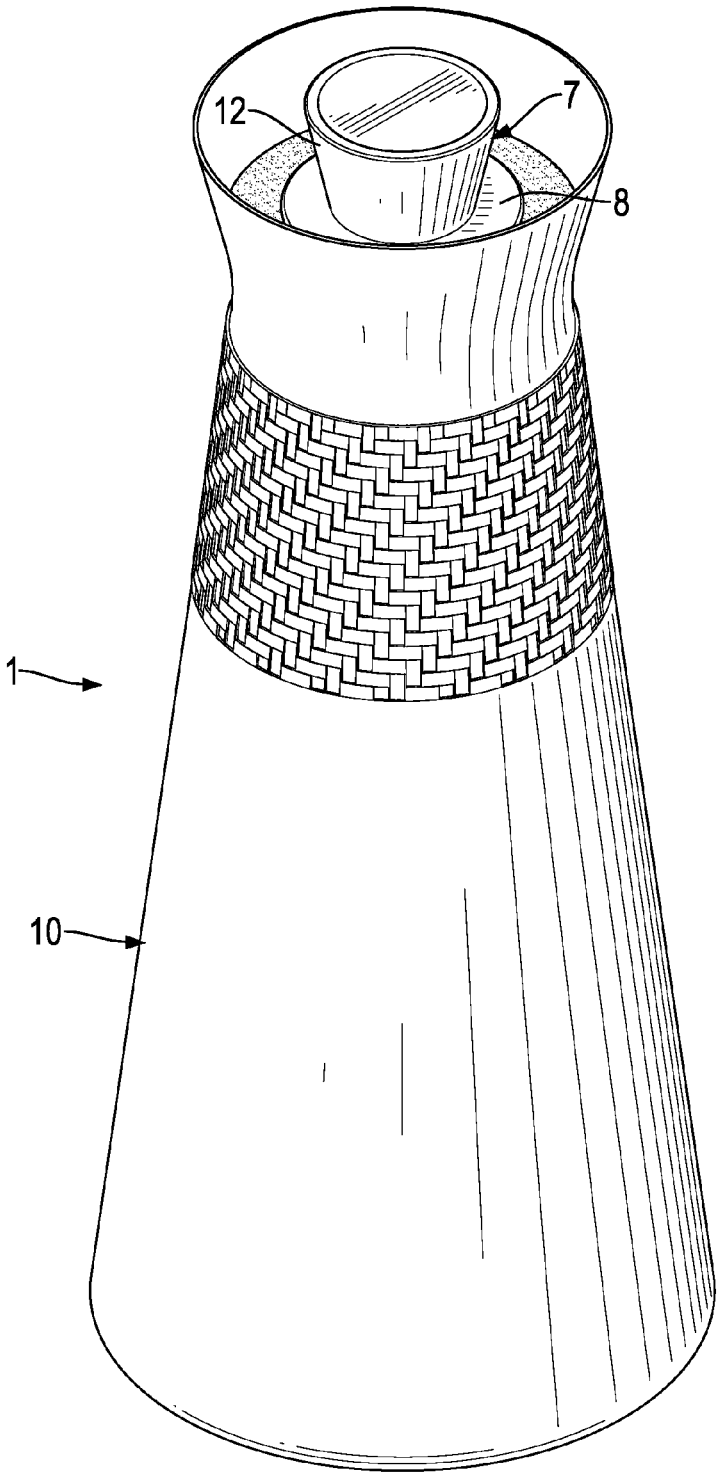
FIG. 1 is a perspective view of a first embodiment of a carafe in accordance with the present invention.
Figure 2:
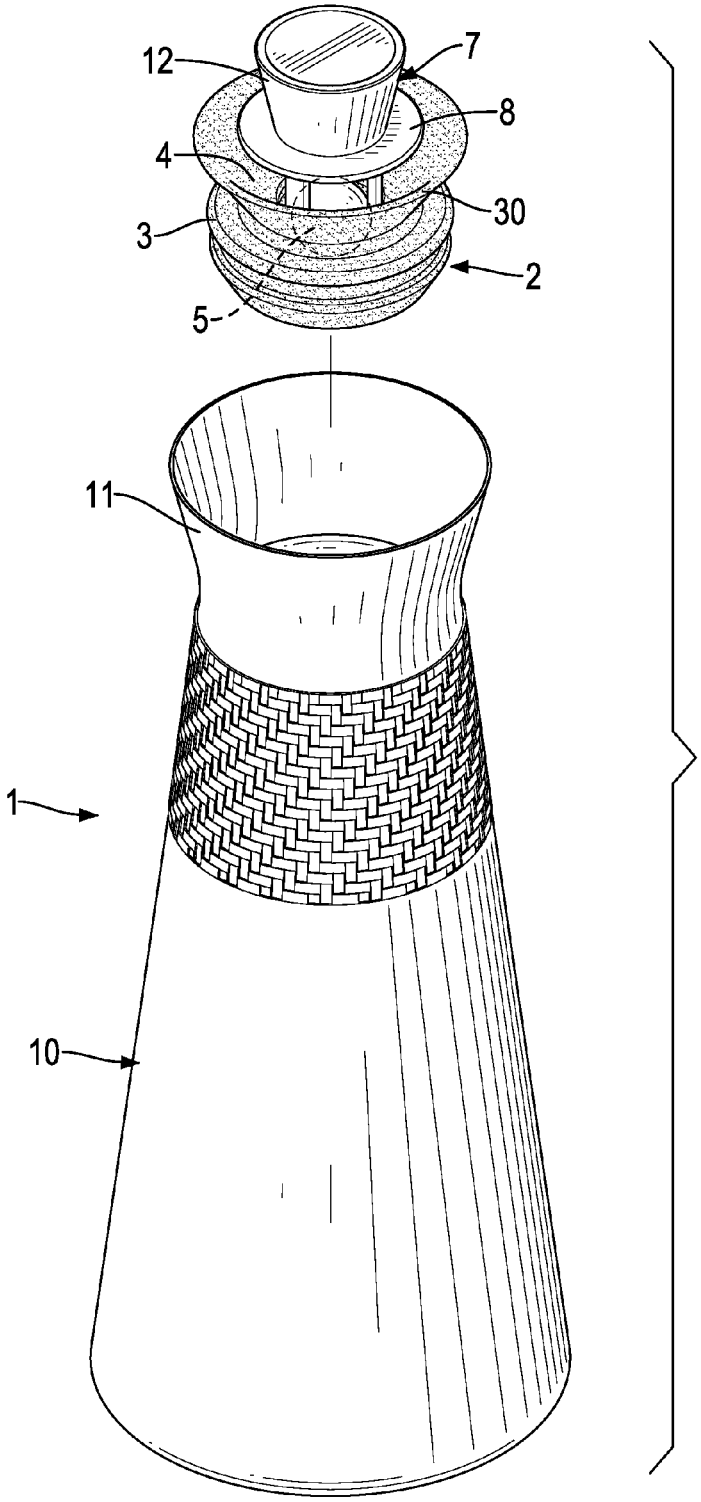
FIG. 2 is an exploded perspective view of the carafe in FIG. 1.

With reference to FIGS. 1 and 2, a carafe in accordance with the present invention comprises a flask 1 and a lid assembly 2.

Figure 3:
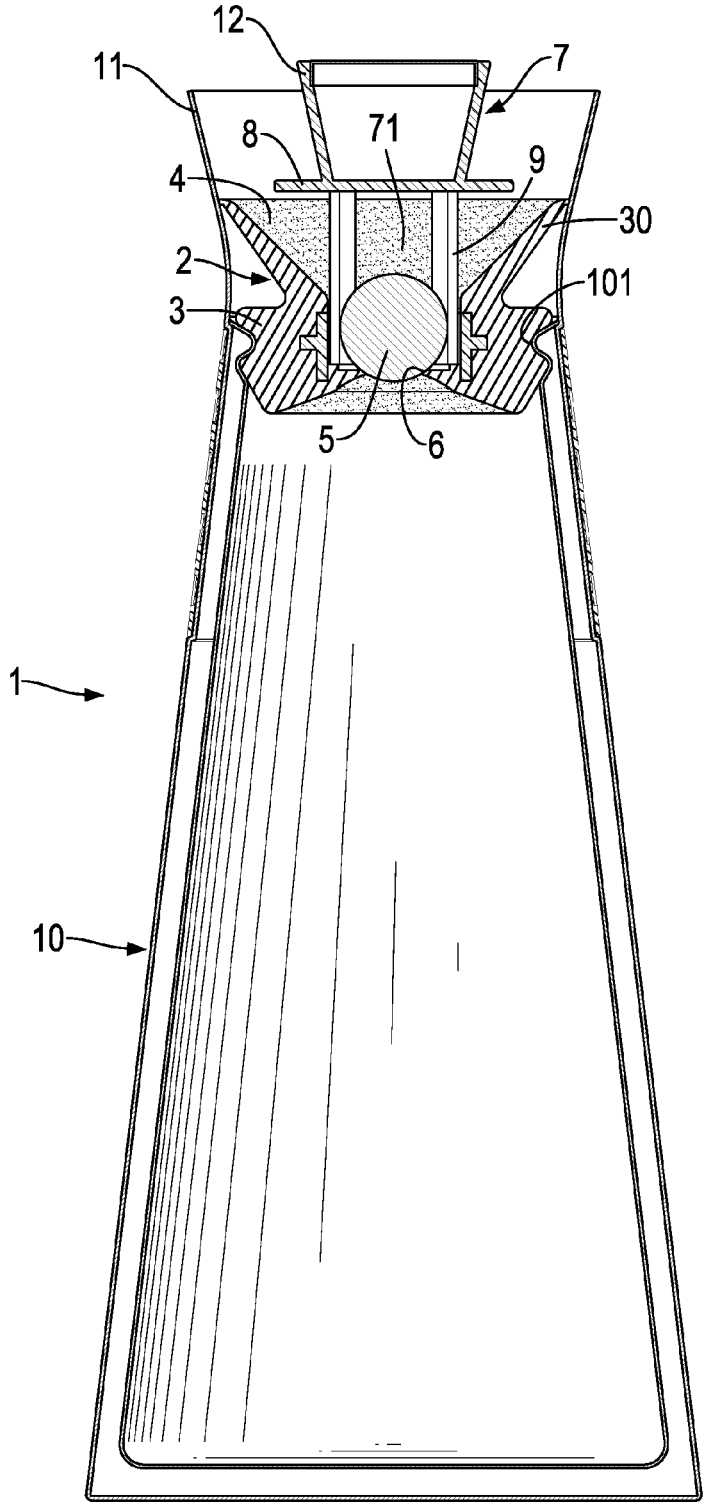
FIG. 3 is a cross-sectional side view of the carafe in FIG. 1.

With further reference to FIG. 3, the flask 1 may be made of stainless steel, ceramic, plastic, or the like and has a vessel 10 and an upper peripheral panel 11. The vessel 10 is for containing liquid and may be single-layered or double-layered. The vessel 10 that is double-layered is helpful for temperature retention of the liquid in the vessel. The vessel 10 has an opening 101 and an upper peripheral edge. The upper peripheral edge of the vessel 10 surrounds the opening 101 of the vessel 10. The upper peripheral panel 11 protrudes from the upper peripheral edge of the vessel 10, is arced outward in cross-section, and has a distal peripheral edge.

The lid assembly 2 is detachably mounted in the opening 101 of the vessel 10 and includes a plug lid 3, a limiting bracket 7, and a sealing ball 5.

The plug lid 3 may be made of silicone, is detachably attached to the upper peripheral edge of the vessel 10 in a watertight manner, and has an outlet port 4. An upper portion 30 of the plug lid 3 may be conical and tapered downward. An interior of the vessel 10 communicates with an exterior of the vessel 10 via the outlet port 4, and the outlet port 4 has an upper end and a lower end 6. A diameter of the upper end of the outlet port 4 is larger than a diameter of the lower end 6 of the outlet port 4, such that the outlet port 4 is tapered from the upper end of the outlet port 4 to the lower end 6 of the outlet port 4. The distal peripheral edge of the upper peripheral panel 11 of the flask 1 extends higher than the upper end of the outlet port 4 of the plug lid 3.

The limiting bracket 7 is mounted in the outlet port 4 of the plug lid 3, is connected to the plug lid 3, and has a guiding channel 71 and at least one outlet. The guiding channel 71 communicates with the interior of the vessel 10 via the lower end 6 of the outlet port 4 of the plug lid 3. The guiding channel 71 communicates with the upper end of the outlet port 4 of the plug lid 3 via the at least one outlet of the limiting bracket 7.

The sealing ball 5 may be made of stainless steel or high density composite material, or may be a weight covered with resilient material. The sealing ball 5 is slidably mounted in the guiding channel 71 of the limiting bracket 7. A diameter of the sealing ball 5 is larger than the diameter of the lower end 6 of the outlet port 4 of the plug lid 3, such that the sealing ball 5 selectively seals the lower end 6 of the outlet port 4 of the plug lid 3.

When the opening 101 of the vessel 10 of the flask 1 faces upward, the sealing ball 5 slides downward due to the gravity and seals the lower end 6 of the outlet port 4 of the plug lid 3. When the vessel 10 of the flask 1 is tilted and the opening 101 of the vessel 10 faces downward, the sealing ball 5 slides away from the lower end 6 of the outlet port 4 of the plug lid 3 due to the gravity. Thus, the lower end 6 of the outlet port 4 is open and the liquid in the vessel 10 can flow through the outlet port 4 of the plug lid 3 and the at least one outlet of the limiting bracket 7 to flow out of the vessel 10.

Specifically, the limiting bracket 7 has a top panel 8 and a holding portion 12. The top panel 8 has a lower surface and an upper surface. The holding portion 12 is formed on the upper surface of the top panel 8. A user can hold the holding portion 12 to remove the lid assembly 2 from the opening 101 of the vessel 10 or to put the lid assembly 2 in the opening of the vessel 10. The guiding channel 71 of the limiting bracket 7 is surrounded by multiple limiting rods 9. The limiting rods 9 protrude down from the lower surface of the top panel 8 and are separately arranged on the top panel 8. Each of the limiting rods 9 has a distal end. The distal end of the limiting rod 9 is securely connected to the plug lid 3. Each of the at least one outlet of the limiting bracket 7 is defined between each two of the limiting rods 9 that are disposed next to each other.

As shown in FIG. 3, in a first preferred embodiment, the plug lid 3 resiliently abuts the upper peripheral edge of the vessel 10 to seal the opening 101 of the vessel 10. The guiding channel 71 of the limiting bracket 7 is surrounded by at least three limiting rods 9. Each of the limiting rods 9 of the limiting bracket 7 longitudinally protrudes down from and is perpendicular to the top panel 8.

Figure 4:
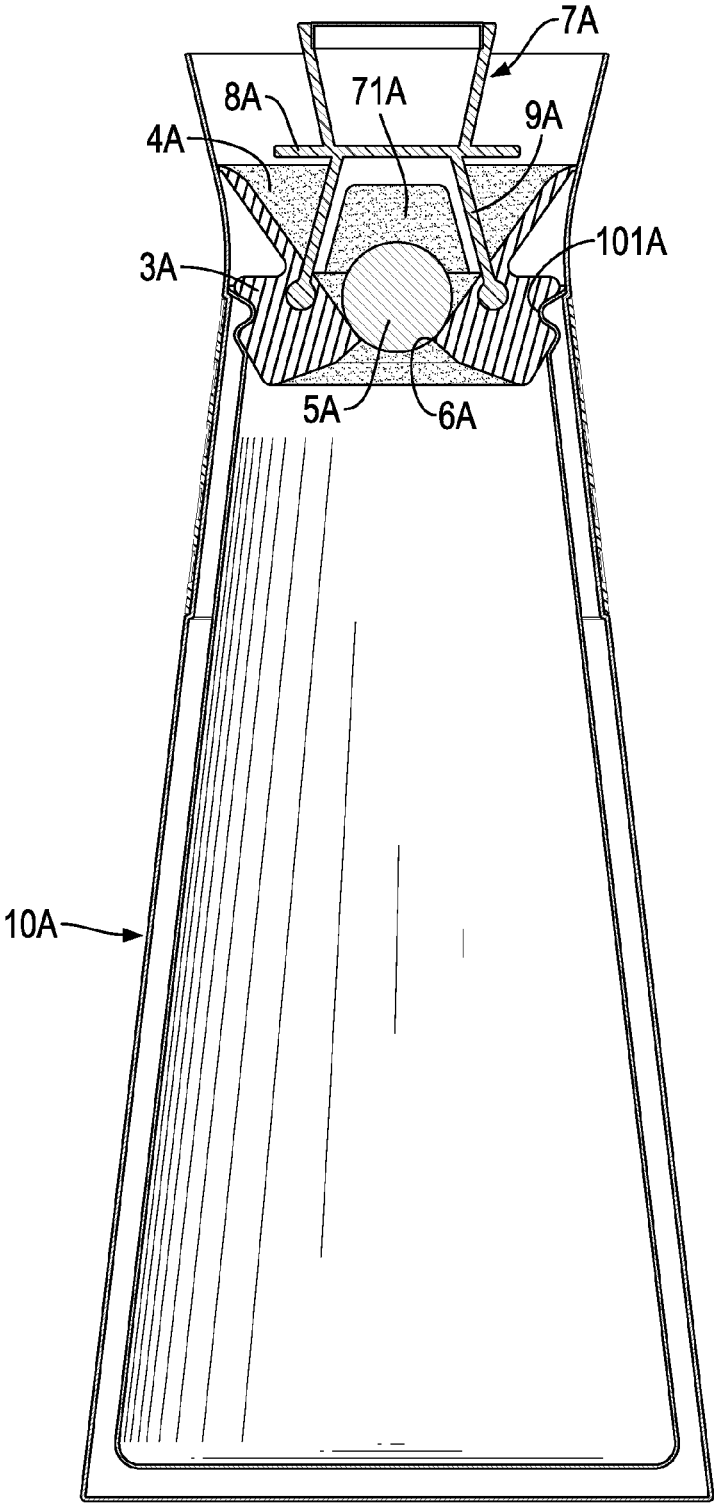
FIG. 4 is a cross-sectional side view of a second embodiment of a carafe in accordance with the present invention.

With reference to FIG. 4, in a second preferred embodiment, the plug lid 3A resiliently abuts the upper peripheral edge of the vessel 10A to seal the opening 101A of the vessel 10A. Each of the limiting rods 9A of the limiting bracket 7A obliquely protrudes down from the lower surface of the top panel 8A and extends outwardly. Each of the limiting rods 9A may be straight. Thus, the guiding channel 71A of the limiting bracket 7A is conical and is tapered from a lower portion of the guiding channel 71A to an upper portion of the guiding channel 71A. Since the outlet port 4A of the plug lid 3A is tapered from the upper end of the outlet port 4A to the lower end 6A of the outlet port 4A, a sliding space formed by the guiding channel 71A and the lower end 6A of the outlet port 4A of the plug lid 3A is drum-shaped. Thus, diameters defined in a middle portion of the sliding space are larger than diameters defined in an upper portion of the sliding space and in a lower portion of the sliding space. Moreover, the largest diameter defined in the middle portion of the sliding space is larger than the diameter of the sealing ball 5A.

Alternatively, each of the limiting rods may be arced inward. Thus, the guiding channel of the limiting bracket is arched in cross-section. The sliding space is formed by the guiding channel 71A that is arched in cross-section and the conical lower end 6A of the outlet port 4A of the plug lid 3A. Alternatively, the guiding channel 71, 71A of the limiting bracket 7, 7A may be surrounded by a net. The net may be cylindrical. Or the net may be conical, such that the guiding channel 71A of the limiting bracket 7A is also conical and the diameter defined in the middle portion of the sliding space is larger than each of the diameters defined in the upper and lower portions of the sliding space. Additionally, the net may be arced in cross-section, such that the guiding channel of the limiting bracket is arched in cross-section. The sliding space is formed by the guiding channel that is arched in cross-section and the conical lower end 6A of the outlet port 4A of the plug lid 3A.

Figure 5:
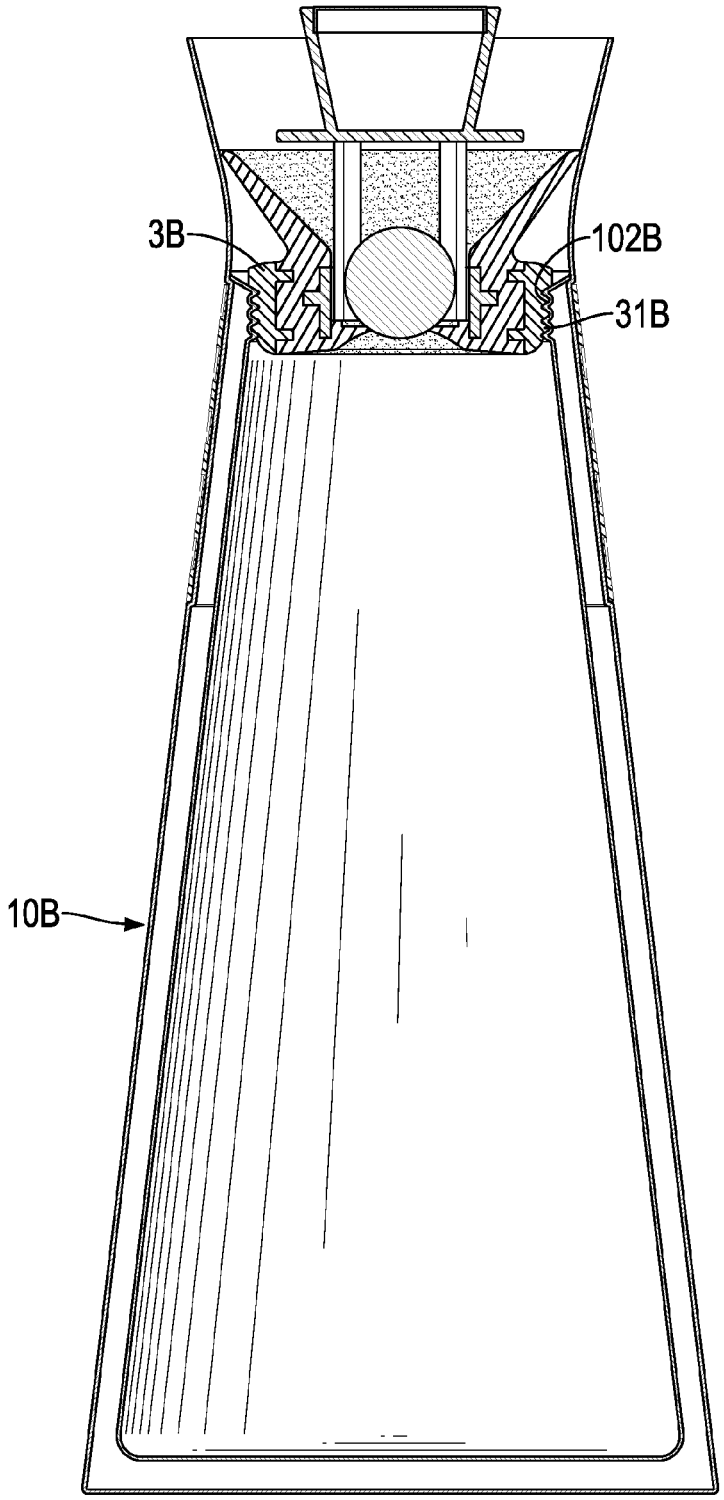
FIG. 5 is a cross-sectional side view of a third embodiment of a carafe in accordance with the present invention.

With reference to FIG. 5, the plug lid 3B has an outer sidewall and an outer thread 31B. The outer thread 31B is formed on the outer sidewall of the plug lid 3B. The vessel 10B has an inner sidewall and an inner thread 102B. The inner thread 102B is formed on the inner sidewall of the vessel 10B adjacent to the upper peripheral edge of the vessel 10B. Thus, the plug lid 3B is engaged with the upper peripheral edge of the vessel 10B by the outer thread 31B of the plug lid 3B engaging the inner thread 102B of the vessel 10B.

The carafe as described has the following advantages. As soon as the flask 1 is tilted and the opening 101, 101A of the vessel 10, 10A, 10B faces downward, the sealing ball 5 slides away from the lower end 6 of the outlet port 4, 4A, such that the liquid in the vessel 10, 10A, 10B can flow out of the vessel 10, 10A, 10B. The user does not have to press or turn the lid assembly 2. Therefore, it is convenient to pour the liquid out of the vessel 10, 10A, 10B.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A carafe comprising:

a flask having a vessel, the vessel having an opening; and an upper peripheral edge surrounding the opening of the vessel;

a lid assembly detachably mounted in the opening of the vessel and including a plug lid detachably attached to the upper peripheral edge of the vessel in a watertight manner and having an outlet port, the outlet port having a lower end and an upper end, wherein an interior of the vessel communicates with an exterior of the vessel via the outlet port;

a limiting bracket mounted in the outlet port of the plug lid, connected to the plug lid, and having a guiding channel communicating with the interior of the vessel via the lower end of the outlet port of the plug lid; and at least one outlet, the guiding channel communicating with the upper end of the outlet port of the plug lid via the at least one outlet; and a sealing ball slidably mounted in the guiding channel of the limiting bracket, a diameter of the sealing ball being larger than a diameter of the lower end of the outlet port of the plug lid, such that the sealing ball selectively seals the lower end of the outlet port of the plug lid;

wherein when the opening of the vessel faces upward, the sealing ball slides downward due to the gravity and seals the lower end of the outlet port of the plug lid; and when the vessel tilts and the opening of the vessel faces downward, the sealing ball slides away from the lower end of the outlet port of the plug lid due to the gravity, and the lower end of the outlet port is open and liquid in the vessel can flow through the outlet port of the plug lid and the at least one outlet of the limiting bracket to flow out of the vessel.

2. The carafe as claimed in claim 1, wherein the limiting bracket has a top panel, and the top panel has a lower surface; and the guiding channel of the limiting bracket is surrounded by at least three limiting rods, and the limiting rods protrude down from the lower surface of the top panel and are separately arranged on the top panel.

3. The carafe as claimed in claim 2, wherein the top panel of the limiting bracket further has an upper surface; and the limiting bracket further has a holding portion formed on the upper surface of the top panel.

4. The carafe as claimed in claim 1, wherein the outlet port of the plug lid is tapered from the upper end of the outlet port to the lower end of the outlet port; and a sliding space is formed by the guiding channel and the lower end of the outlet port of the plug lid, and a largest diameter defined in the sliding space is larger than the diameter of the sealing ball.

5. The carafe as claimed in claim 4, wherein the limiting bracket has a top panel, and the top panel has a lower surface;

the guiding channel of the limiting bracket is surrounded by multiple limiting rods, and each of the limiting rods of the limiting bracket obliquely protrudes down from the lower surface of the top panel and extends outwardly; and diameters defined in a middle portion of the sliding space are larger than diameters defined in an upper portion of the sliding space and in a lower portion of the sliding space.

6. The carafe as claimed in claim 4, wherein the limiting bracket has a top panel, and the top panel has a lower surface;

the guiding channel of the limiting bracket is surrounded by a net, and the net is conical; and diameters defined in a middle portion of the sliding space are larger than diameters defined in an upper portion of the sliding space and in a lower portion of the sliding space.

7. The carafe as claimed in claim 4, wherein the limiting bracket has a top panel, and the top panel has a lower surface;

the guiding channel of the limiting bracket is surrounded by multiple limiting rods, and each of the limiting rods of the limiting bracket is arced inward and protrudes down from the lower surface of the top panel;

the guiding channel of the limiting bracket is arched in cross-section; and the sliding space is formed by the guiding channel that is arched in cross-section and the lower end of the outlet port of the plug lid.

8. The carafe as claimed in claim 4, wherein the limiting bracket has a top panel, and the top panel has a lower surface;

the guiding channel of the limiting bracket is surrounded by a net, and the net is arced in cross-section;

the guiding channel of the limiting bracket is arched in cross-section; and the sliding space is formed by the guiding channel that is arched in cross-section and the lower end of the outlet port of the plug lid.

9. The carafe as claimed in claim 4, wherein the sealing ball is made of stainless steel or high density composite material, or is a weight covered with resilient material.

10. The carafe as claimed in claim 4, wherein the vessel has an inner thread, and the inner thread is formed on an inner sidewall of the vessel adjacent to the upper peripheral edge of the vessel;

the plug lid has an outer thread, and the outer thread is formed on an outer sidewall of the plug lid and selectively engages the inner thread of the vessel.

11. The carafe as claimed in claim 4, wherein the plug lid resiliently abuts the upper peripheral edge of the vessel.

12. The carafe as claimed in claim 1, wherein an upper portion of the plug lid is conical and tapers downward.

13. The carafe as claimed in claim 12, wherein the flask further has an upper peripheral panel, the upper peripheral panel protrudes from the upper peripheral edge of the vessel, is arced outward in cross-section, and has a distal peripheral edge, and the distal peripheral edge of the upper peripheral panel of the flask extends higher than the upper end of the outlet port of the plug lid.

* * * * *